US009118120B2

(12) United States Patent
Cviko et al.

(10) Patent No.: US 9,118,120 B2
(45) Date of Patent: Aug. 25, 2015

(54) ANTENNA ARRANGEMENT FOR WIRELESS COMMUNICATION

(75) Inventors: Mirsad Cviko, Malmo (SE); Alexandre Pinto, Copenhagen (DK)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 14/009,848

(22) PCT Filed: Apr. 6, 2011
(Under 37 CFR 1.47)

(86) PCT No.: PCT/IB2011/051483

§ 371 (c)(1),
(2), (4) Date: Feb. 10, 2014

(87) PCT Pub. No.: WO2012/137040

PCT Pub. Date: Oct. 11, 2012

(65) Prior Publication Data

US 2014/0327589 A1 Nov. 6, 2014

(51) Int. Cl.

| | |
|---|---|
| ***H01Q 1/24*** | (2006.01) |
| ***H01Q 13/10*** | (2006.01) |
| ***H01Q 9/42*** | (2006.01) |
| ***H01Q 5/364*** | (2015.01) |

(52) U.S. Cl.
CPC ..... *H01Q 13/10* (2013.01); *H01Q 5/364* (2015.01); *H01Q 9/42* (2013.01)

(58) Field of Classification Search
CPC ..... H01Q 1/243; H01Q 13/10; H01Q 9/42; H01Q 5/364
USPC ..... 343/702, 846, 848, 876
See application file for complete search history.

(56) References Cited

U.S. PATENT DOCUMENTS

| | | | | |
|---|---|---|---|---|
| 6,476,769 | B1 | 11/2002 | Lehtola | |
| 7,551,142 | B1 | 6/2009 | Zhang et al. | |
| 2006/0092081 | A1* | 5/2006 | Kanazawa | 343/702 |
| 2006/0273964 | A1* | 12/2006 | Kanazawa | 343/702 |
| 2007/0040752 | A1* | 2/2007 | Sinasi et al. | 343/702 |

(Continued)

FOREIGN PATENT DOCUMENTS

| | | | |
|---|---|---|---|
| CN | 101471490 | A | 7/2009 |
| EP | 1296410 | A1 | 3/2003 |

(Continued)

OTHER PUBLICATIONS

Extended European Search Report received for corresponding European Patent Application No. 11863247.0, dated Aug. 19, 2014, 6 pages.

(Continued)

*Primary Examiner* — Hoanganh Le
(74) *Attorney, Agent, or Firm* — Harrington & Smith

(57) ABSTRACT

An apparatus comprising: a conductive member configured to receive an antenna and to form a non-conductive region between the conductive member and a ground member; and a switch having a first closed configuration and a second open configuration, the first closed configuration being configured to couple the conductive member to the ground member across the non-conductive region and to provide a first current path having a first electrical length and a first resonant frequency, the second open configuration being configured to provide a second current path having a second electrical length and a second resonant frequency, the second resonant frequency being lower than the first resonant frequency.

21 Claims, 4 Drawing Sheets

(56) References Cited

U.S. PATENT DOCUMENTS

| | | | | |
|---|---|---|---|---|
| 2008/0246674 | A1 | 10/2008 | Rutfors et al. | |
| 2009/0085813 | A1 | 4/2009 | Wang et al. | |
| 2010/0245201 | A1 | 9/2010 | Hossain et al. | |
| 2011/0254744 | A1 * | 10/2011 | Sumi | 343/702 |

FOREIGN PATENT DOCUMENTS

| | | | |
|---|---|---|---|
| EP | 1396906 | A1 | 3/2004 |
| EP | 1538694 | A1 | 6/2005 |
| EP | 1755191 | A1 | 2/2007 |
| GB | 2361584 | A | 10/2001 |
| TW | 200929699 | A | 7/2009 |
| WO | 0129927 | A1 | 4/2001 |
| WO | 2007/040639 | A1 | 4/2007 |
| WO | 2008/059106 | A1 | 5/2008 |
| WO | 2009037353 | A1 | 3/2009 |

OTHER PUBLICATIONS

International Search Report and Written Opinion received in corresponding Patent Cooperation Treaty Application No. PCT/IB2011/051483. Dated Nov. 29, 2011. 10 pages.

* cited by examiner

ANTENNA ARRANGEMENT FOR WIRELESS COMMUNICATION

RELATED APPLICATION

This application was originally filed as PCT Application No. PCT/IB2011/051483 filed Apr. 6, 2011.

TECHNOLOGICAL FIELD

Embodiments of the present invention relate to apparatus for wireless communication. In particular, they relate to apparatus for wireless communication in a portable communication device.

BACKGROUND

Apparatus, such as portable communication devices, usually include an antenna arrangement for enabling the apparatus to communicate wirelessly. Users of such apparatus may require the ability to communicate in multiple operational frequency bands. For example, in the United States of America, the Global system for mobile communications (US-GSM) has the frequency band 824-894 MHz, whereas in Europe, the Global system for mobile communication (EGSM) has the frequency band 880-960 MHz. However, such users also usually desire the apparatus to be as small as possible and the reduction in the size of the apparatus may reduce the antenna arrangements efficiency and/or bandwidth in the multiple operational frequency bands.

For example, due to the size constraints on an apparatus, a printed wiring board of the apparatus may have a natural mode of resonance which is not the same as the resonant mode of the antenna and this may reduce efficiency and/or bandwidth. For example, a printed wiring board's first resonant mode may be approximately 1.1 to 1.3 GHz, whereas the antenna may resonate at 1.9 GHz.

Therefore, it would be desirable to provide an alternative apparatus.

BRIEF SUMMARY

According to various, but not necessarily all, embodiments of the invention there is provided an apparatus comprising: a conductive member configured to receive an antenna and to form a non-conductive region between the conductive member and a ground member; and a switch having a first closed configuration and a second open configuration, the first closed configuration being configured to couple the conductive member to the ground member across the non-conductive region and to provide a first current path having a first electrical length and a first resonant frequency, the second open configuration being configured to provide a second current path having a second electrical length and a second resonant frequency, the second resonant frequency being lower than the first resonant frequency.

The apparatus may be for wireless communication.

The apparatus may further comprise a variable reactive member in series with the switch and between the ground member and the conductive member. The variable reactive member may have a plurality of different impedances for enabling the first resonant frequency to be varied.

The apparatus may further comprise at least one processor; and at least one memory including computer program code, the at least one memory and the computer program code may be configured to, with the at least one processor, cause the apparatus at least to perform controlling the switch to switch between the first closed configuration and the second open configuration.

The switch may have a third configuration configured to couple the conductive member to the ground member across the non-conductive region via a reactive member, the third configuration being configured to provide a third current path having a third electrical length and a third resonant frequency, the third resonant frequency being different to the first resonant frequency and the second resonant frequency.

The conductive member may be separate from, and connectable to the ground member.

The conductive member may be integral with the ground member.

The conductive member may have a first end and a second open end, the first end being coupled to the ground member, and the second open end being configured to receive the antenna and to couple to the switch.

The apparatus may further comprise one or more further switches coupled between the conductive member and the ground member.

The conductive member may include one or more reactive members.

According to various, but not necessarily all, embodiments of the invention there is provided a module comprising an apparatus as described in any of the preceding paragraphs.

According to various, but not necessarily all, embodiments of the invention there is provided a portable communication device comprising an apparatus as described in any of the preceding paragraphs.

According to various, but not necessarily all, embodiments of the invention there is provided a method comprising: controlling a switch to switch between a first closed configuration and a second open configuration, the first closed configuration being configured to couple a conductive member to a ground member across a non-conductive region defined between the conductive member and the ground member and to provide a first current path having a first electrical length and a first resonant frequency, the second open configuration being configured to provide a second current path having a second electrical length and a second resonant frequency, the second resonant frequency being lower than the first resonant frequency.

The method may further comprise controlling a variable reactive member, in series with the switch and between the conductive member and the ground member, to have an impedance selected from a plurality of different impedances for enabling the first resonant frequency to be varied.

The method may further comprise controlling the switch to switch to a third configuration, the third configuration being configured to couple the conductive member to the ground member across the non-conductive region via a reactive member, and to provide a third current path having a third electrical length and a third resonant frequency, the third resonant frequency being different to the first resonant frequency and the second resonant frequency.

The conductive member may be separate from, and connectable to the ground member.

The conductive member may be integral with the ground member.

The conductive member may have a first end and a second open end, the first end being coupled to the ground member, and the second open end being configured to receive the antenna and to couple to the switch.

The method may further comprise controlling one or more further switches coupled between the conductive member and the ground member.

The conductive member may include one or more reactive members.

According to various, but not necessarily all, embodiments of the invention there is provided an apparatus comprising: at least one processor; and at least one memory including computer program code, the at least one memory and the computer program code configured to, with the at least one processor, cause the apparatus at least to perform a method as described in any of the preceding paragraphs.

According to various, but not necessarily all, embodiments of the invention there is provided a computer-readable storage medium encoded with instructions that, when executed by a processor, perform a method as described in any of the preceding paragraphs.

According to various, but not necessarily all, embodiments of the invention there is provided a computer program that, when run on a computer, performs a method as described in any of the preceding paragraphs.

BRIEF DESCRIPTION

For a better understanding of various examples of embodiments of the present invention reference will now be made by way of example only to the accompanying drawings in which.

DETAILED DESCRIPTION

In the following description, the wording 'connect' and 'couple' and their derivatives mean operationally connected or coupled. It should be appreciated that any number or combination of intervening components can exist (including no intervening components). Additionally, it should be appreciated that the connection or coupling may be a physical galvanic connection and/or an electromagnetic connection.

Figure 2:
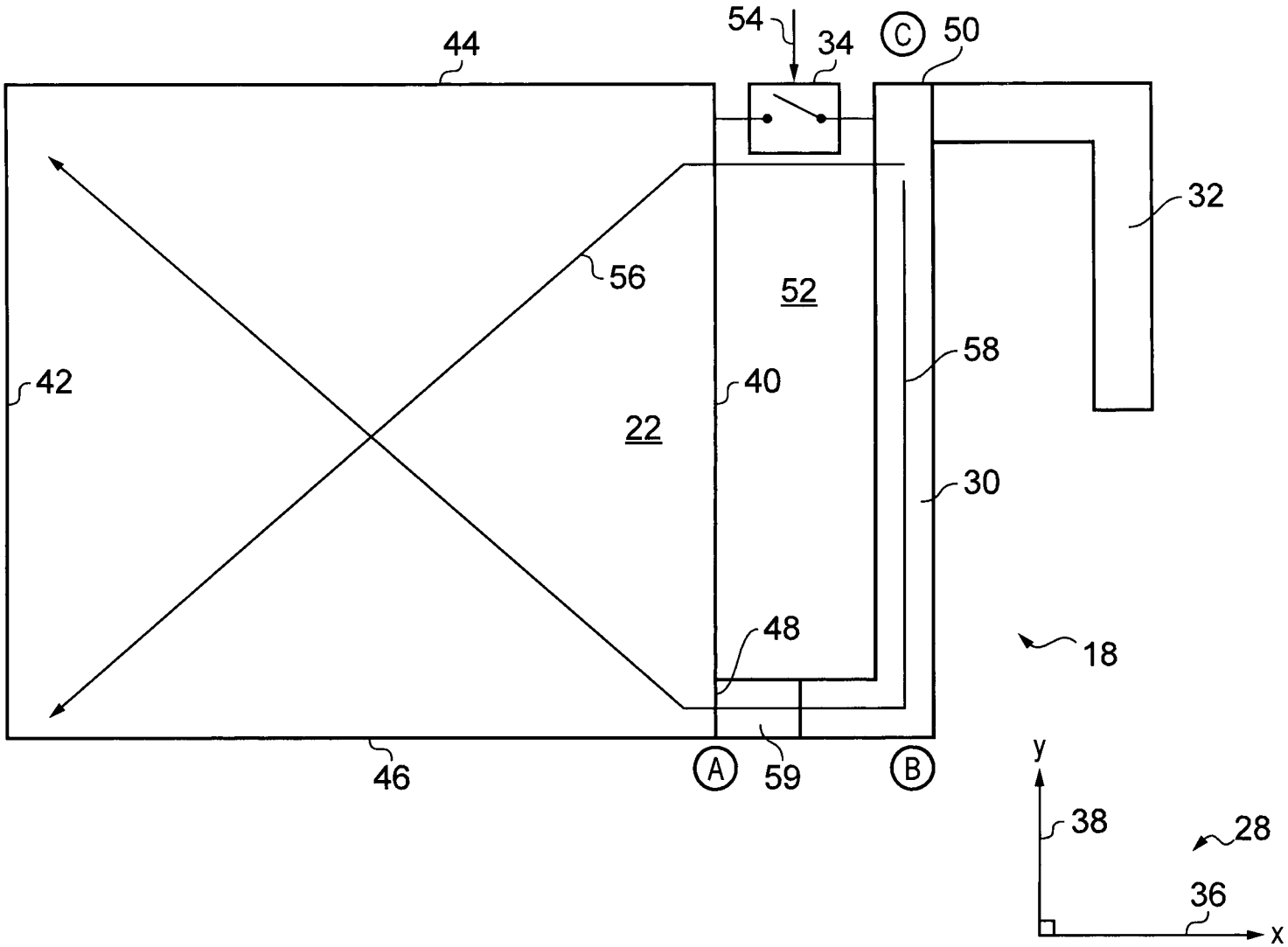
FIG. 2 illustrates a plan view of an apparatus according to various embodiments of the invention.
Figure 3:
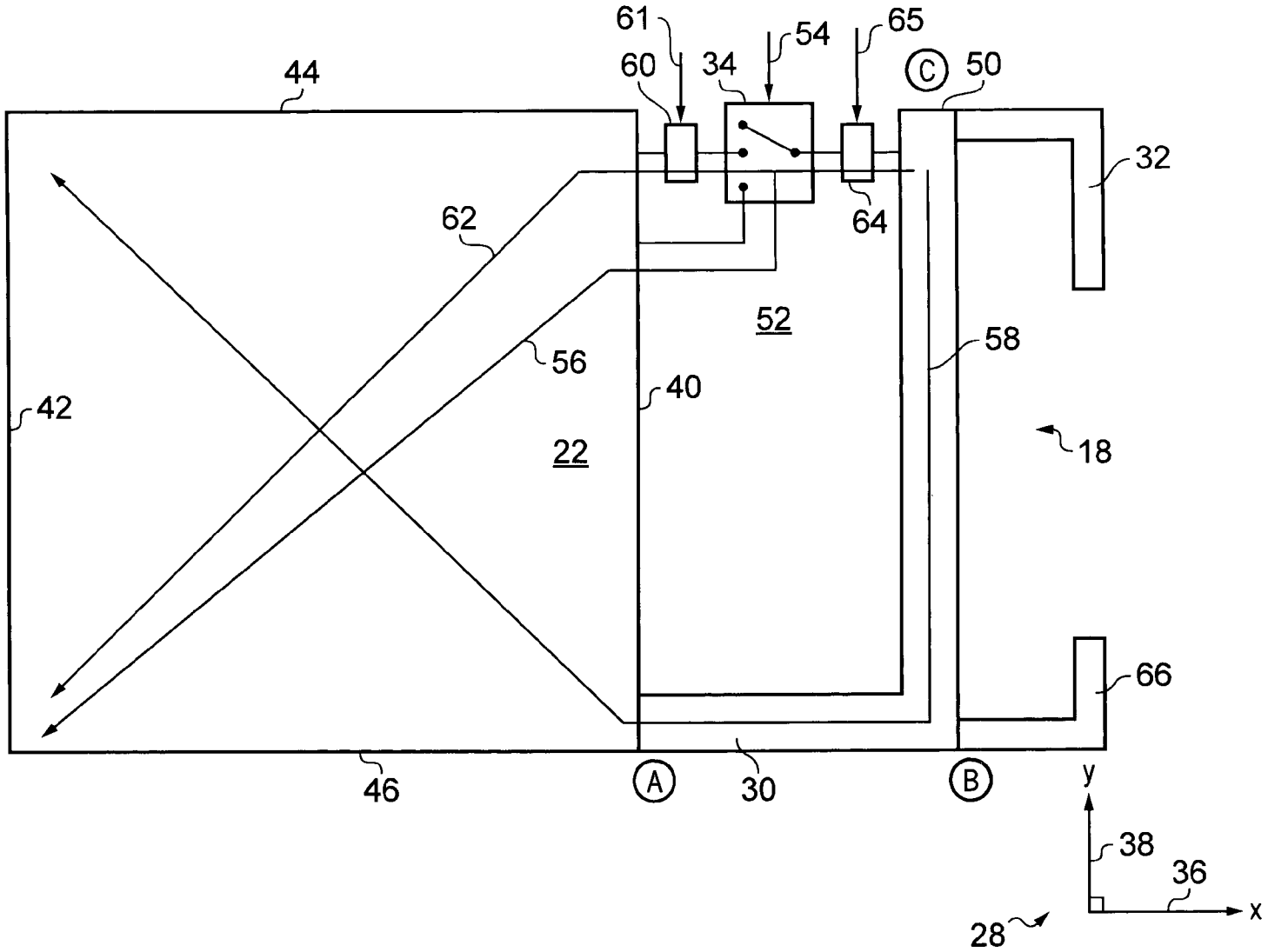
FIG. 3 illustrates a plan view of another apparatus according to various embodiments of the invention.

FIGS. 2 and 3 illustrate an apparatus 18 comprising: a conductive member 30 configured to receive an antenna 32 and to form a non-conductive region 52 between the conductive member 30 and a ground member 22; and a switch 34 having a first closed configuration and a second open configuration, the first closed configuration being configured to couple the conductive member 30 to the ground member 22 across the non-conductive region 52 and to provide a first current path 56 having a first electrical length and a first resonant frequency, the second open configuration being configured to provide a second current path 58 having a second electrical length and a second resonant frequency, the second resonant frequency being lower than the first resonant frequency.

Figure 1:
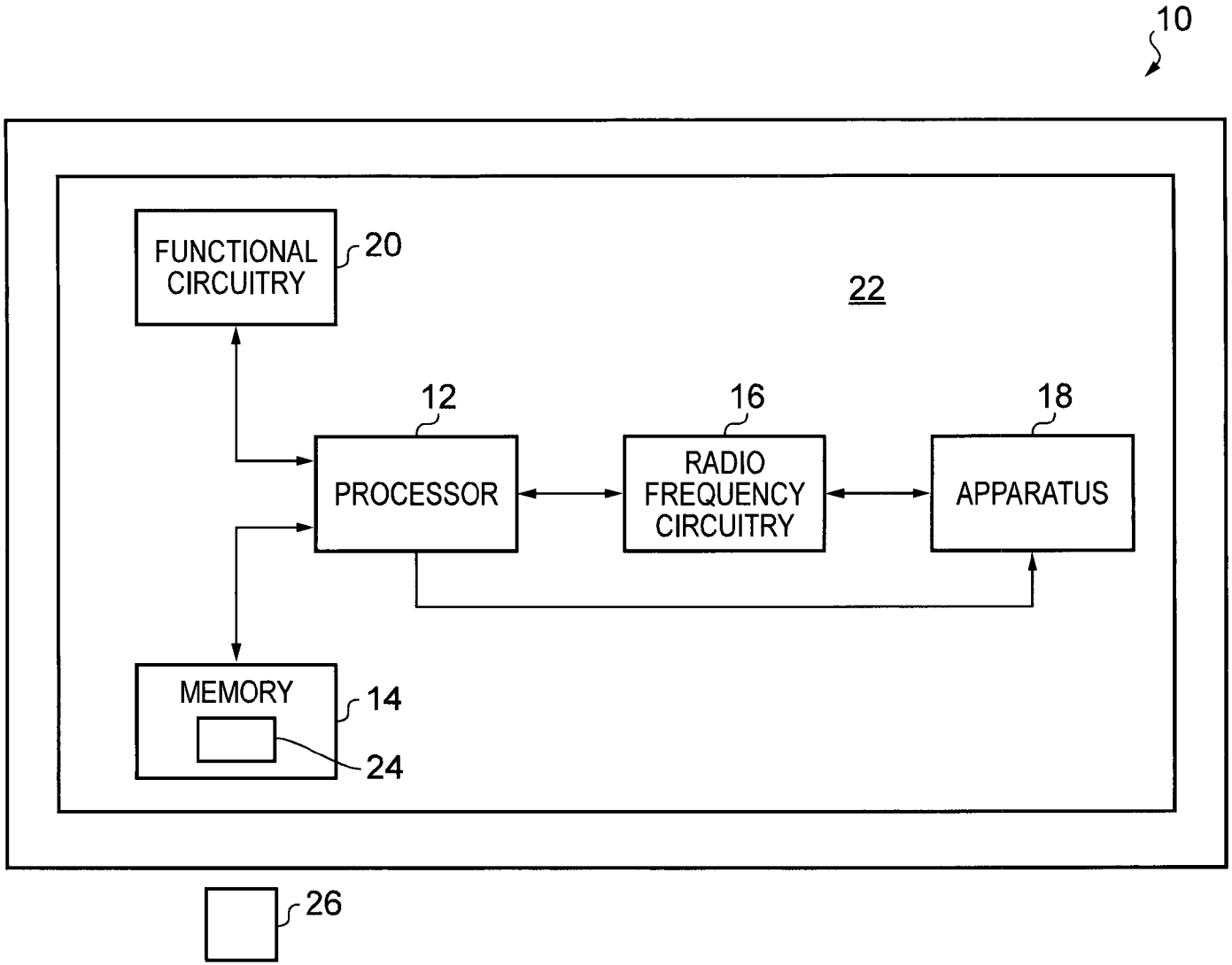
FIG. 1 illustrates a schematic diagram of a portable communication device according to various embodiments of the invention.

In more detail, FIG. 1 illustrates an electronic communication device 10 according to various embodiments of the invention. The electronic communication device 10 comprises one or more processors 12, one or more memories 14, radio frequency circuitry 16, an apparatus 18, functional circuitry 20 and a ground member 22.

The electronic communication device 10 may be any apparatus and may be a portable communication device (for example, a mobile cellular telephone, a tablet computer, a laptop computer, a personal digital assistant or a hand held computer), or a module for such devices. As used here, 'module' refers to a unit or apparatus that excludes certain parts or components that would be added by an end manufacturer or a user.

The implementation of the processor 12 can be in hardware alone (for example, a circuit), have certain aspects in software including firmware alone or can be a combination of hardware and software (including firmware).

The processor 12 may be implemented using instructions that enable hardware functionality, for example, by using executable computer program instructions in a general-purpose or special-purpose processor that may be stored on a computer readable storage medium (disk, memory etc) to be executed by such a processor.

The processor 12 is configured to read from and write to the memory 14. The processor 12 may also comprise an output interface via which data and/or commands are output by the processor 12 and an input interface via which data and/or commands are input to the processor 12.

The memory 14 may be any suitable memory and may be solid state memory or a hard disk for example. The memory 14 stores a computer program 24 comprising computer program instructions that control the operation of the apparatus 18 when loaded into the processor 12. The computer program instructions 24 provide the logic and routines that enables the apparatus 18 to perform the method illustrated in FIG. 4. The processor 12 by reading the memory 14 is able to load and execute the computer program 24.

The computer program may arrive at the electronic device 10 via any suitable delivery mechanism 26. The delivery mechanism 26 may be, for example, a computer-readable storage medium, a computer program product, a memory device, a record medium such as a compact disc read-only memory (CD-ROM) or digital versatile disc (DVD), an article of manufacture that tangibly embodies the computer program 24. The delivery mechanism may be a signal configured to reliably transfer the computer program 24. The electronic communication device 10 may propagate or transmit the computer program 24 as a computer data signal.

Although the memory 14 is illustrated as a single component it may be implemented as one or more separate components some or all of which may be integrated/removable and/or may provide permanent/semi-permanent/dynamic/cached storage.

The apparatus 18 may be referred to as an antenna arrangement and is configured to enable wireless communication with other electronic communication devices. The radio frequency circuitry 16 may be configured to receive signals from the processor 12, encode the signals, and provide the encoded signals to the apparatus 18 for transmission. The radio frequency circuitry 16 may additionally or alternatively be configured to receive signals from the apparatus 18, decode the signals, and provide the decoded signals to the processor 12.

The apparatus 18 and the radio frequency circuitry 16 may be configured to operate in one or more operational frequency bands and via one or more protocols. For example, the operational frequency bands and protocols may include (but are not limited to) Long Term Evolution (LTE) 700 (US) (698.0-716.0 MHz, 728.0-746.0 MHz), LTE 1500 (Japan) (1427.9-1452.9 MHz, 1475.9-1500.9 MHz), LTE 2600 (Europe) (2500-2570 MHz, 2620-2690 MHz), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); hyper local area network (HLAN) (5150-5850 MHz); global positioning system (GPS) (1570.42-1580.42 MHz); US-Global system for mobile communications (US-GSM) 850 (824-894

MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting-handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification ultra high frequency (RFID UHF) (433 MHz, 865-956 MHz, 2450 MHz).

A frequency band over which the apparatus 18 can efficiently operate using a protocol is a frequency range where the return loss of the apparatus 18 is greater than an operational threshold. For example, efficient operation may occur when the return loss of the apparatus 18 is better than −6 dB or −10 dB.

The functional circuitry 20 includes additional circuitry of the electronic communication device 10. In the embodiment where the electronic device 10 is a portable communication device, the functional circuitry 20 may include input/output devices such as an audio input device (a microphone for example), an audio output device (a loudspeaker for example), a user input device (a touch screen display, a keypad or a keyboard for example) and a display.

The apparatus 18, the electronic components that provide the radio frequency circuitry 16, the processor 12, the memory 14 and the functional circuitry 20 may be interconnected via the ground member 22 (for example, a printed wiring board). The ground member 22 may be used as a ground plane for the apparatus 18 by using one or more layers of the printed wiring board. In other embodiments, some other conductive part of the electronic communication device 10 (a battery cover or separate printed wiring board for example) may be used as the ground member for the apparatus 18. The ground member 22 may be formed from several conductive parts of the electronic communication device 10, for example and not limited to the printed wiring board, a conductive battery cover, and/or at least a portion of a cover of the electronic communication device 10. It should be appreciated that the ground member 22 may be planar or non-planar.

FIG. 2 illustrates a plan view of an apparatus 18 according to various embodiments of the invention and a Cartesian co-ordinate system 28. The apparatus 18 includes a ground member 22, a conductive member 30, an antenna 32 and a switch 34. The Cartesian co-ordinate system 28 includes an X axis 36 and a Y axis 38 which are orthogonal to one another.

The ground member 22 includes a first side edge 40, a second side edge 42, a third side edge 44 and a fourth side edge 46. The first side edge 40 and the second side edge 42 are parallel to one another and are also parallel with the Y axis 38. The third side edge 44 and the fourth side edge 46 are parallel to one another and are also parallel with the X axis 36. The third and fourth side edges 44, 46 are positioned between the first and second side edges 40, 42. It should be appreciated that in other embodiments, the ground member 22 may include any number of side edges and/or at least one of the side edges may have a partially or entirely curved shape.

The conductive member 30 includes a first end 48 and a second open end 50. The first end 48 of the conductive member 30 is coupled to the ground member 22 at the corner of the ground member 22 defined by the first side edge 40 and the fourth side edge 46 (position (A)). The conductive member 30 extends from position (A) in the +X direction until position (B) where it forms a right angled turn and then extends in the +Y direction until the second open end 50 at position (C). Consequently, a non-conductive region 52 is defined between the first side edge of the ground member 22 and the conductive member 30 (and may be viewed as a slot between the ground member 22 and the conductive member 30). In some embodiments, the non-conductive region 52 may be empty and in other embodiments, the non-conductive region 52 may include FR4 printed wiring board material therein.

The conductive member 30 is configured to receive the antenna 32 at position (C) (that is, at the second open end 50 of the conductive member 30). For example, the conductive member 30 includes a feed point and a ground point at the second open end 50 for coupling to the antenna 32. The feed point and/or the ground point to the antenna 32 may be provided via at least one of a microstrip, stripline, coaxial cable, or other known transmission line, along the length of the conductive member 30 and arranged to couple with the radio frequency circuitry 16. It should be appreciated that the conductive member 30 may be configured to receive the antenna 32 at any position along its length and may be configured to receive the antenna 32 at position (B) for example. The antenna 32 may, in other exemplary embodiments, include only a feed point between the antenna 32 and the second open end 50 of the conductive member 30, for coupling RF (radio frequency) signals between antenna 32 and the radio frequency circuitry 16.

In this embodiment, the conductive member 30 is planar with the ground member 22. In other embodiments however, the conductive member 30 may not be planar with the ground member 22 and may be positioned to at least partially overlay the ground member 22 when viewed in plan.

The conductive member 30 is integral with the ground member 22 in this embodiment. For example, the conductive member 30 may be formed from one or more of the conductive layers of the ground member 22 by removing a section of the ground member 22 corresponding to the non-conductive region 52. Consequently, the conductive member 30 may be referred to as a ground member extension arm. In other embodiments, the conductive member 30 may be separate from the ground member 22 and may be coupled to the ground member 22 via soldering or via a spring connector, for example.

The conductive member 30 may define a non-conductive region 52 which is an irregular shape. That is, the non-conductive region 52 has a shape which may be L-shaped for example or some other shape which is not a rectangle. The non-conductive region 52 may be defined between the conductive member 30 and more than one edge of the ground member 22.

The antenna 32 may be any suitable antenna and may be, for example, a planar inverted F antenna (PIFA), an inverted F antenna (IFA), a planar inverted L antenna (PILA), a monopole antenna or a loop antenna. In this embodiment, the antenna 32 is planar with the ground member 22 and with the conductive member 30. In other embodiments however, the antenna 32 may be non-planar with the ground member 22 and/or with the conductive member 30. Furthermore, the antenna 32 may at least partially overlay the conductive member 30 and/or the non-conductive region 52 and/or the ground member 22.

The switch 34 is coupled between the corner of the ground member 22 defined by the first side edge 40 and the third side edge 44, and the second open end 50 of the conductive member 30. It should be appreciated that in other embodiments, the switch 34 may be coupled to other positions along the length of the first side edge 40 and to other positions along the length of the conductive member 30. There may also be more than one switch coupled between the conductive member 30 and the first edge 40 so that a plurality of electrical paths may be provided for different operating frequencies and/or bands.

The switch 34 has a first closed configuration and a second open configuration. The processor 12 is configured to provide a control signal 54 to the switch 34 to control the configuration of the switch 34.

The first closed configuration is configured to couple the conductive member 30 to the ground member 22 across the non-conductive region 52. Consequently, when the switch 34 is in the first closed configuration, the switch 34 closes the non-conductive region 52. The first closed configuration provides a first current path 56 that extends from the second open end 50 of the conductive member 30, through the switch 34 and to the ground member 22 (for example, from the corner defined by the first side edge 40 and the third side edge 44 to the corner defined by the second side edge 42 and the fourth side edge 46). The first current path 56 has a first electrical length and is resonant at a first resonant frequency.

Furthermore, when the switch 34 is in the first closed configuration, a further radio frequency resonant mode may be formed around the non-conductive region 52 in the conductive member 30 and in the ground member 22 (that is, the non-conductive region/slot 52 may also contribute a resonant mode).

The second open configuration is configured to disconnect the conductive member 30 from the ground member 22 at the switch 34 and thereby provide a second current path 58. Consequently, when the switch 34 is in the second open configuration, the switch 34 opens the non-conductive region 52. The second current path 58 extends from the second open end 50 of the conductive member 30 to the first end 48 of the conductive member 30, and then to the ground member 22 (for example, from the corner defined by the first side edge 40 and the fourth side edge 46 to the corner defined by the second side edge 42 and the third side edge 44). The second current path 58 has a second electrical length that is longer than the first electrical length. The second current path 58 is resonant at a second resonant frequency. Since the second electrical length is longer than the first electrical length, the second resonant frequency is lower than the first resonant frequency.

In some embodiments, the conductive member 30 may include one or more reactive components 59 at position (A) or anywhere along the length of the conductive member 30. For example, the conductive member 30 may be coupled to the ground member 22 at position (A) via a series inductor to elongate the second current path 58. In various embodiments, an inductor-capacitor (LC) arrangement could be inserted to provide a frequency selective path.

Various embodiments provide an advantage in that the first and second resonant frequencies of the first and second current paths 56, 58 may be optimized (for example, by selecting appropriate electrical lengths) for two different operational resonant frequency bands of the antenna 32. In more detail, the first resonant frequency may be selected to be within a first operational resonant frequency band of the antenna 32, and the second resonant frequency may be selected to be within a second operational resonant frequency band of the antenna 32. When the antenna 32 is in operation in the first or second operational resonant frequency band, the antenna 32 excites the first or second resonant frequency respectively. Consequently, the apparatus 18 may operate efficiently in two or more different operational frequency bands.

Various embodiments also provide the advantage in that the optimization of the first and second current paths 56, 58 for the first and second operational frequency bands may result in the first and second operational frequency bands having relatively wide bandwidths (relative to the antenna 32 being provided on a standard printed wiring board which does not have a conductive member 30). Furthermore, since the switch 34 is not placed in series with the antenna 34 radio frequency feed path, losses are minimized.

FIG. 3 illustrates a plan view of another apparatus 18 according to various embodiments of the invention. The apparatus 18 illustrated in FIG. 3 is similar to the apparatus illustrated in FIG. 2 and where the features are similar, the same reference numeral are used.

The apparatus 18 illustrated in FIG. 3 differs from the apparatus illustrated in FIG. 2 in that the switch 34 has a third configuration that is configured to couple the conductive member 30 to the ground member 22 across the non-conductive region 52 via a first reactive member 60. The first reactive member 60 may be any suitable reactive member and may include one or more capacitors and/or one or more inductors. In some embodiments, the first reactive member 60 may have a variable impedance and the processor 12 may be configured to control the impedance of the first reactive member 60 via a control signal 61.

The third configuration is configured to provide a third current path 62 that has a third electrical length. The third current path 62 extends from the second open end 50 of the conductive member 30, through the switch 34 and the first reactive member 60 and to the ground member 22 (for example, from the corner defined by the first side edge 40 and the third side edge 44 to the corner defined by the second side edge 42 and the fourth side edge 46). The third current path 62 is resonant at a third resonant frequency (which may be variable if the first reactive member 60 is variable) that is different to the first resonant frequency and to the second resonant frequency.

The apparatus 18 illustrated in FIG. 3 may also differ from the apparatus illustrated in FIG. 2 in that it may (optionally) include a second variable reactive member 64 in series between the conductive member 30 and the switch 34. The second variable reactive member 64 may include one or more variable capacitors and/or one or more variable inductors. The second variable reactive member 64 has a plurality of different impedances for enabling the first resonant frequency and the third resonant frequency to be varied. In other embodiments, the second variable reactive member 64 may be provided in series between the ground member 22 and the switch 34.

The second variable reactive member 64 may be configured to receive a control signal 65 from the processor 12 and change impedance in response. For example, the processor 12 may determine that the electronic device 10 is in a particular use state (for example, being used to make a telephone call), and then control the impedance of the second variable reactive member 64 dynamically to compensate for the change in impedance caused by the change in use state.

The apparatus 18 also includes a further antenna 66 that is coupled to the conductive member 30 at position (B). In other embodiments, the further antenna 66 may be coupled to the conductive member 30 at any suitable position along the length of the conductive member 30. The further antenna 66 may be any suitable antenna and may be, for example, a planar inverted F antenna (PIFA), an inverted F antenna (IFA), a planar inverted L antenna (PILA), a monopole antenna or a loop antenna.

In this embodiment, the further antenna 66 is planar with the ground member 22, the conductive member 30 and the antenna 32. In other embodiments however, the further antenna 66 may be non-planar with the ground member 22 and/or the conductive member 30 and/or the antenna 32. Additionally, the further antenna 66 may at least partially overlay the conductive member 30 and/or the non-conductive region 52 and/or the ground member 22.

It should be appreciated that the switch 34 may provide a plurality of different current paths that are optimized for the operational frequency bands of the further antenna 66. In various embodiments, the antenna 32 may be a low band antenna and the further antenna 66 may be a high band antenna and the switch 34 is configured to optimize the operation of the apparatus 18 in the low and high operational frequency bands.

Figure 4:
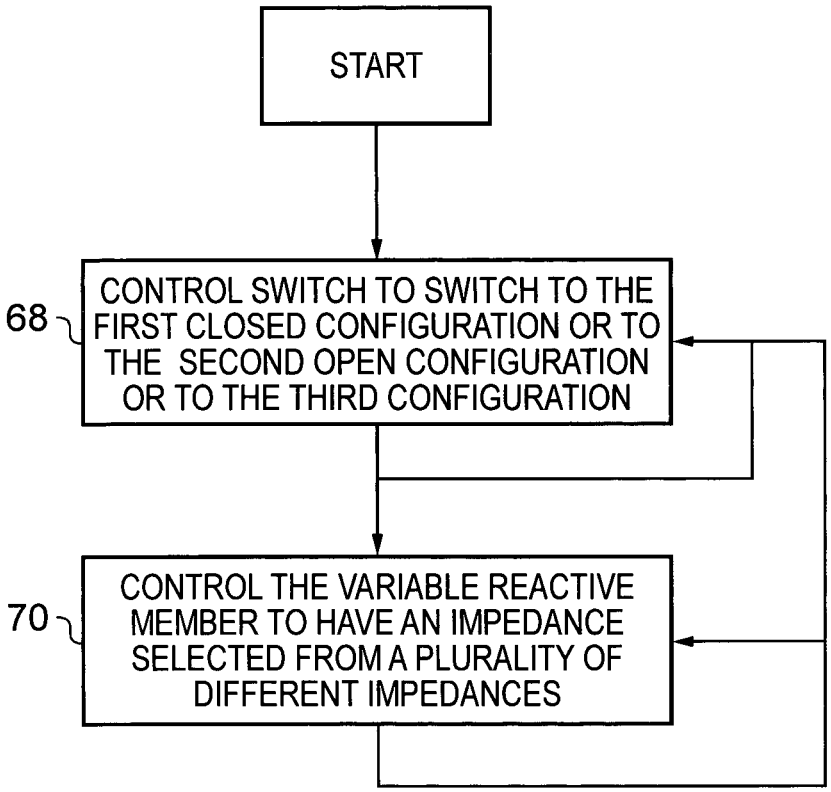
FIG. 4 illustrates a flow diagram of a method according to various embodiments of the invention.

FIG. 4 illustrates a flow diagram of a method according to various embodiments of the invention.

At block 68, the method includes controlling the switch 34 to switch to the first closed configuration or to the second open configuration or (optionally) to the third configuration. For example, the processor 12 may determine that the operational frequency band of the antenna 32 is to change from the first operational frequency band to the second operational frequency band, and in response, control the switch to change from the first closed configuration to the second open configuration.

Where the apparatus 18 includes one or more further switches between the conductive member 30 and the ground member 22, block 68 also includes controlling the one or more further switches as described for the switch 34.

The method may then return to block 68 or (optionally) continue to block 70.

At block 70, the method includes controlling the second variable reactive member 64 to have an impedance selected from a plurality of different impedances. For example, the processor 12 may determine if the use state of the electronic device 10 has changed as described above, and then control the impedance of the second variable reactive member 64 dynamically to compensate for the change in impedance caused by the change in use state.

The method may then return to block 68 or to block 70.

References to 'computer-readable storage medium', 'computer program product', 'tangibly embodied computer program' and so on, or a 'controller', 'computer', 'processor' and so on, should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code and so on, should be understood to encompass software for a programmable processor or firmware such as, for example, the programmable content of a hardware device whether instructions for a processor, or configuration settings for a fixed-function device, gate array or programmable logic device and so on.

As used in this application, the term 'circuitry' refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device." The blocks illustrated in the FIG. 4 may represent steps in a method and/or sections of code in the computer program 24. The illustration of a particular order to the blocks does not necessarily imply that there is a required or preferred order for the blocks and the order and arrangement of the block may be varied. Furthermore, it may be possible for some blocks to be omitted.

Although embodiments of the present invention have been described in the preceding paragraphs with reference to various examples, it should be appreciated that modifications to the examples given can be made without departing from the scope of the invention as claimed. For example, the switch 34 may have any number of electrical configurations that provide different current paths between the conductive member 30 and the ground member 22. Additionally, while the figures illustrate right angled turns in the conductive member 30 and the antennas 32, 66, it should be appreciated that the turns may be more or less than ninety degrees and may be curved.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

a conductive member configured to receive an antenna and to form a slot between the conductive member and a ground member; and a switch having a first closed configuration and a second open configuration, the first closed configuration being configured to couple the conductive member to the ground member across the slot and to provide a first current path having a first electrical length and a first resonant frequency, the second open configuration being configured to provide a second current path having a second electrical length and a second resonant frequency, the second resonant frequency being lower than the first resonant frequency, and wherein the conductive member has a first end and a second end, the first end being coupled to the ground member, and the conductive member being configured to receive the antenna and the second end of the conductive member configured to couple to the switch, and wherein the conductive member includes at least one of a feed point and a ground point configured to couple to the antenna, and wherein the first current path extends from the second end of the conductive member through the switch to the ground member and the second current path extends from the second end of the conductive member via the first end of the conductive member to the ground member.

2. An apparatus as claimed in claim 1, further comprising a variable reactive member in series between the switch and the conductive member, the variable reactive member having a plurality of different impedances for enabling the first resonant frequency to be varied.

3. An apparatus as claimed in claim 1, further comprising at least one processor; and at least one memory including computer program code, the at least one memory and the computer program code configured to, with the at least one processor, cause the apparatus at least to perform controlling the switch to switch between the first closed configuration and the second open configuration.

4. An apparatus as claimed in claim 1, wherein the switch has a third configuration configured to couple the conductive member to the ground member across the slot via a reactive member, the third configuration being configured to provide a third current path having a third electrical length and a third resonant frequency, the third resonant frequency being different to the first resonant frequency and the second resonant frequency.

5. An apparatus as claimed in claim 1, wherein the conductive member is separate from, and connectable to the ground member.

6. An apparatus as claimed in claim 1, wherein the conductive member is integral with the ground member.

7. An apparatus as claimed in claim 1, wherein the second open end is configured to receive the antenna.

8. An apparatus as claimed in claim 1, wherein the conductive member includes the feed point and the ground point at the second end for coupling to the antenna.

9. An electronic communication device comprising the apparatus according to claim 1.

10. A method comprising:

providing a conductive member configured to receive an antenna; and controlling a switch to switch between a first closed configuration and a second open configuration, the first closed configuration being configured to couple the conductive member to a ground member across a slot defined between the conductive member and the ground member and to provide a first current path having a first electrical length and a first resonant frequency, the second open configuration being configured to provide a second current path having a second electrical length and a second resonant frequency, the second resonant frequency being lower than the first resonant frequency, and wherein the conductive member has a first end and a second end, the first end being coupled to the ground member, and the conductive member being configured to receive the antenna and the second end of the conductive member configured to couple to the switch, and wherein the conductive member includes at least one of a feed point and a ground point configured to couple to the antenna, and wherein the first current path extends from the second end of the conductive member through the switch to the ground member and the second current path extends from the second end of the conductive member via the first end of the conductive member to the ground member.

11. A method as claimed in claim 10, further comprising controlling a variable reactive member, in series between the switch and the conductive member, to have an impedance selected from a plurality of different impedances for enabling the first resonant frequency to be varied.

12. A method as claimed in claim 10, further comprising controlling the switch to switch to a third configuration, the third configuration being configured to couple the conductive member to the ground member across the slot via a reactive member, and to provide a third current path having a third electrical length and a third resonant frequency, the third resonant frequency being different to the first resonant frequency and the second resonant frequency.

13. A method as claimed in claim 10, wherein the conductive member is separate from, and connectable to the ground member.

14. A method as claimed in claim 10, wherein the conductive member is integral with the ground member.

15. The method as claimed in claim 10, wherein the conductive member includes the feed point and the ground point at the second end for coupling to the antenna.

16. An apparatus comprising:

at least one processor; and at least one memory including computer program code, the at least one memory and the computer program code configured to, with the at least one processor, cause the apparatus at least to:

control a switch to switch between a first closed configuration and a second open configuration, the first closed configuration being configured to couple a conductive member to a ground member across a slot defined between the conductive member and the ground member and to provide a first current path having a first electrical length and a first resonant frequency, the second open configuration being configured to provide a second current path having a second electrical length and a second resonant frequency, the second resonant frequency being lower than the first resonant frequency, wherein the conductive member is configured to receive an antenna, and wherein the conductive member has a first end and a second end, the first end being coupled to the ground member, and the second end of the conductive member configured to couple to the switch, and wherein the conductive member includes at least one of a feed point and a ground point configured to couple to the antenna, and wherein the first current path extends from the second end of the conductive member through the switch to the ground member and the second current path extends from the second end of the conductive member via the first end of the conductive member to the ground member.

17. The apparatus as claimed in claim 16, wherein the second open end is configured to receive the antenna.

18. The apparatus as claimed in claim 16, wherein the conductive member includes the feed point and the ground point at the second end for coupling to the antenna.

19. A computer program product embodied on a non-transitory computer-readable medium in which a computer program is stored that, when being executed by a computer, is configured to provide instruction to control or carry out:

control a switch to switch between a first closed configuration and a second open configuration, the first closed configuration being configured to couple a conductive member to a ground member across a slot defined between the conductive member and the ground member and to provide a first current path having a first electrical length and a first resonant frequency, the second open configuration being configured to provide a second current path having a second electrical length and a second resonant frequency, the second resonant frequency being lower than the first resonant frequency, wherein the conductive member is configured to receive an antenna, and wherein the conductive member has a first end and a second end, the first end being coupled to the ground member, and the second end of the conductive member configured to couple to the switch, and wherein the conductive member includes at least one of a feed point and a ground point configured to couple to the antenna, and wherein the first current path extends from the second end of the conductive member through the switch to the ground member and the second current path extends from the second end of the conductive member via the first end of the conductive member to the ground member.

20. The computer program product as claimed in claim 19, wherein the second end is configured to receive the antenna.

21. The computer program product as claimed in claim 19, wherein the conductive member includes the feed point and the ground point at the second end for coupling to the antenna.

* * * * *

UNITED STATES PATENT AND TRADEMARK OFFICE

CERTIFICATE OF CORRECTION

PATENT NO. : 9,118,120 B2
APPLICATION NO. : 14/009848
DATED : August 25, 2015
INVENTOR(S) : Cviko et al.

It is certified that error appears in the above-identified patent and that said Letters Patent is hereby corrected as shown below:

IN THE CLAIMS

In Claim 7:

Column 11, line 45, "open" should be deleted.

Signed and Sealed this
Eighth Day of March, 2016

Michelle K. Lee

Michelle K. Lee
*Director of the United States Patent and Trademark Office*